US006696658B2

(12) United States Patent
Kowalyshen et al.

(10) Patent No.: US 6,696,658 B2
(45) Date of Patent: Feb. 24, 2004

(54) CIRCUIT INTERRUPTER AND OPERATING MECHANISM THEREFOR

(75) Inventors: Henry W. Kowalyshen, Niles, IL (US); Andrew C. Shum, Des Plaines, IL (US)

(73) Assignee: S & C Electric Co., Chicago, IL (US)

( * ) Notice: Subject to any disclaimer, the term of this patent is extended or adjusted under 35 U.S.C. 154(b) by 0 days.

(21) Appl. No.: 10/139,812

(22) Filed: May 3, 2002

(65) Prior Publication Data

US 2003/0034331 A1 Feb. 20, 2003

Related U.S. Application Data

(63) Continuation of application No. PCT/US00/30466, filed on Nov. 3, 2000.
(60) Provisional application No. 60/165,413, filed on Nov. 13, 1999.

(51) Int. Cl.[7] ..... H01H 33/28; H01H 5/00
(52) U.S. Cl. ..... 218/154; 200/400
(58) Field of Search ..... 200/400; 218/7, 218/14, 78, 84, 152–154

(56) References Cited

U.S. PATENT DOCUMENTS 5,932,858 A * 8/1999 Meinherz ..... 218/84
6,180,902 B1 * 1/2001 Kowalyshen et al. ..... 200/400
6,437,276 B1 * 8/2002 Bruchmann et al. ..... 218/152
2003/0029702 A1 * 2/2003 Kowalyshen et al. .... 200/43.04

FOREIGN PATENT DOCUMENTS

DE 1095916 A1 * 12/1960
DE 2434438 A * 1/1976
GB 594979 A * 1/1947
WO WO 01-37297 A1 * 5/2001

* cited by examiner

*Primary Examiner*—J. R. Scott
(74) *Attorney, Agent, or Firm*—James V. Lapacek

(57) ABSTRACT

A single-pole circuit interrupter is provided that includes a sealed housing containing a pressurized gas, relatively movable contacts and an operating mechanism for operating the relatively movable contacts. The operating mechanism is responsive to a low-speed rotational charging input and includes energy storage means capable of being charged and storing operating energy and charging means responsive to the low-speed rotational charging input for charging the energy storage means. Thus, the only seal to the environment for the overall single-pole circuit interrupter is at the single low-speed charging input. The operating mechanism includes linear stored energy devices arranged so as to generally define one or more planes or arrays and a latch arrangement that is disposed intermediate the stored energy devices and operating in a direction substantially perpendicular to the one or more planes or arrays. In one arrangement, the operating mechanism incorporates an integral multi-revolution recharging drive and force reducer for recharging the operating mechanism after operation.

10 Claims, 5 Drawing Sheets

CIRCUIT INTERRUPTER AND OPERATING MECHANISM THEREFOR

This application is a continuation of International Application No. PCT/US00/30466 filed on Nov. 3, 2000 which is a continuation of and claims the benefit of U.S. Provisional Application No. 60/165,413 filed on Nov. 13, 1999.

BACKGROUND OF THE INVENTION

1. Field of the Invention

The present invention relates generally to a circuit interrupter and more particularly to a compact operating mechanism for the circuit interrupter having an operating mechanism that includes linear stored energy devices arranged so as to generally define one or more planes or arrays and having a latch arrangement that is disposed intermediate said stored energy devices and operating in a direction substantially perpendicular to the one or more planes or arrays. In one arrangement, the operating mechanism incorporates an integral multi-revolution recharging drive and force reducer for recharging the operating mechanism after operation. In a preferred arrangement, the operating mechanism includes a generally cylindrical housing and is affixed to a generally cylindrical interrupter to provide a single-pole circuit interrupter in a poly-phase electrical power system.

2. Description of Related Art

Various operating mechanisms for electrical switches and circuit interrupters provide operational states at an output corresponding to the desired operational states of the switch controlled by the mechanism.

SUMMARY OF THE INVENTION

Accordingly, it is a principal object of the present invention to provide a single-pole circuit interrupter that includes a sealed housing containing a pressurized gas, relatively movable contacts and an operating mechanism for operating the relatively movable contacts, the operating mechanism being responsive to a low-speed rotational charging input that is the only sealing interface to the environment.

It is a further object of the present invention to provide a compact operating mechanism that includes an efficient configuration of operating springs and a latch as well as a self-contained force-reducing arrangement for manual charging of the operating mechanism.

It is another object of the present invention to provide an operating mechanism having a configuration of operating springs and a latch arrangement wherein the operating springs define one or more planar arrays and a latch arrangement is disposed intermediate the operating springs and acts in a direction generally perpendicular to the planar arrays.

These and other objects of the present invention are achieved by a single-pole circuit interrupter that includes a sealed housing containing a pressurized gas, relatively movable contacts and an operating mechanism for operating the relatively movable contacts. The operating mechanism is responsive to a low-speed rotational charging input and includes energy storage means capable of being charged and storing operating energy and charging means responsive to the low-speed rotational charging input for charging said energy storage means. Thus, the only seal to the environment for the overall single-pole circuit interrupter is at the single low-speed charging input. The operating mechanism includes linear stored energy devices arranged so as to generally define one or more planes or arrays and a latch arrangement that is disposed intermediate the stored energy devices and operating in a direction substantially perpendicular to the one or more planes or arrays. In one arrangement, the operating mechanism incorporates an integral multi-revolution recharging drive and force reducer for recharging the operating mechanism after operation.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
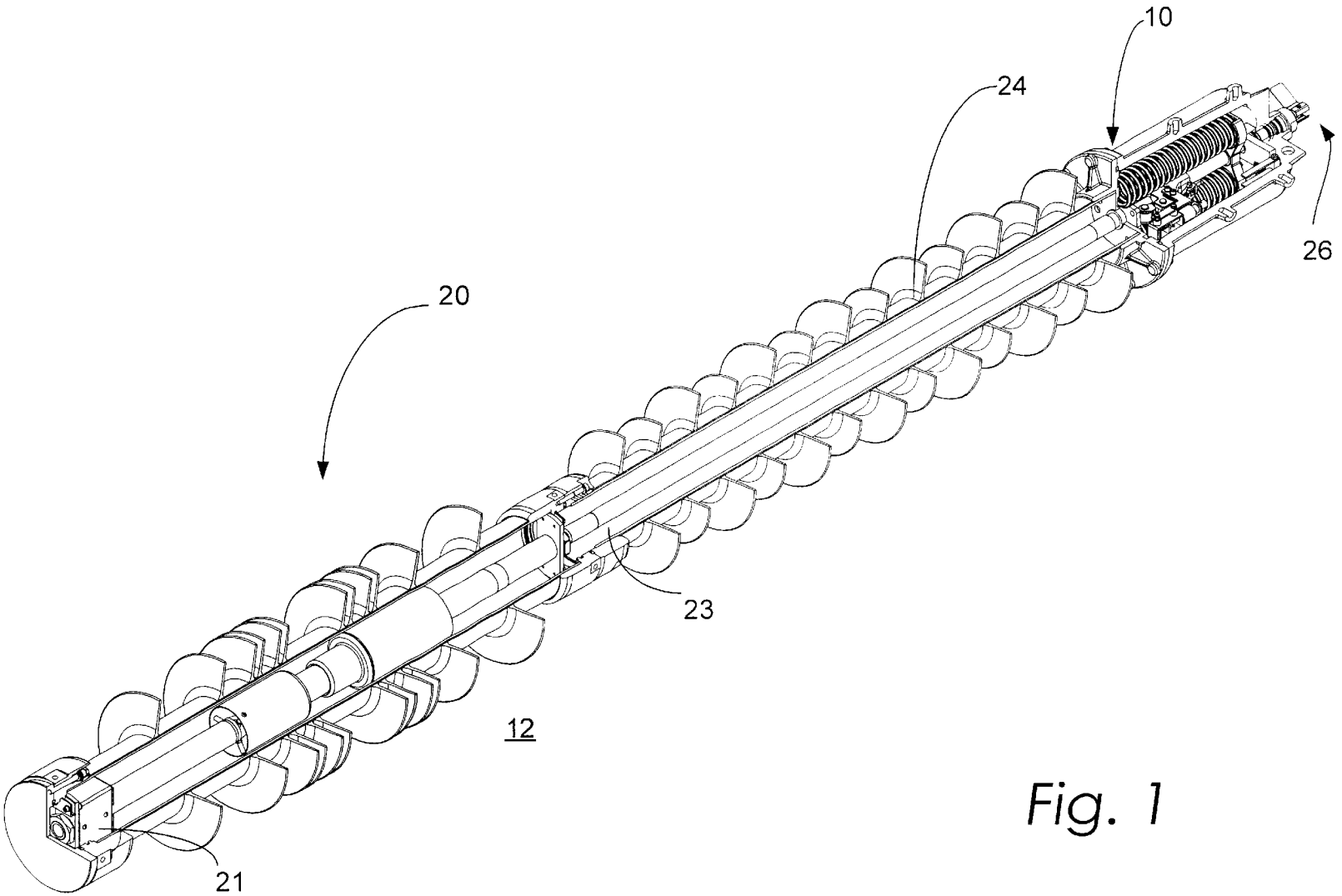
FIG. 1 is a perspective view of a pole-unit protective device including an operating mechanism in accordance with the principles of the present invention.
Figure 2:
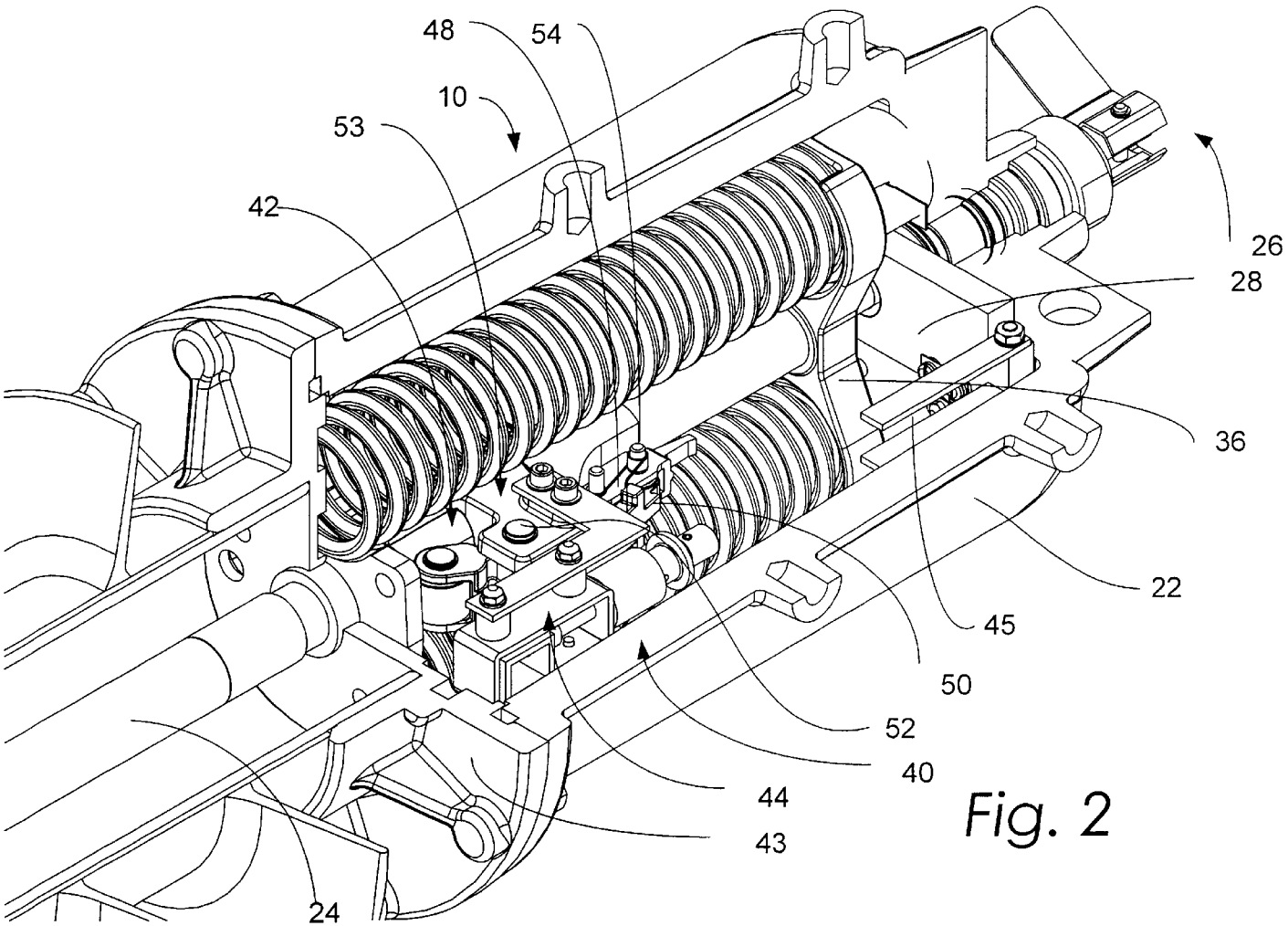
FIG. 2 is a perspective view of the operating mechanism of FIG. 1 with parts cut away and removed for clarity.

Referring now to FIGS. 1 and 2, an operating mechanism 10 in accordance with a specific embodiment of the present invention is illustrated as an integral portion of a pole unit 12 that functions as a protective device, e.g. as one pole of a multi-pole arrangement in an electrical power system. The pole unit 12 includes an interrupter 20 that is operated between open and closed positions by the operating mechanism 10 via an operating rod 24 that may also be characterized as an operating member. In the closed position, the interrupter 20 electrically connects a first circuit terminal at 21 to a second circuit terminal at 23. In the open position, the interrupter 20 breaks the electrical path between the circuit terminals 21, 23. The operating mechanism 10 is situated at ground potential and the first and second circuit terminals 21, 23 are energized at various electrical potentials with respect to the ground potential of the operating mechanism 10. In the illustrative embodiment of FIGS. 1 and 2, the pole unit 12 is generally of an overall cylindrical shape including the interrupter 20 of generally cylindrical shape and the operating mechanism 10 of generally cylindrical shape.

The operating mechanism 10 is of the stored energy type, the interrupter 20 being opened via the release of the energy stored in the operating mechanism 10 when charged. The operating mechanism 10 is charged for operation via a charging input 26 for the next opening operation, the interrupter 20 also being closed during the charging of the operating mechanism 10 via the upward movement of the operating rod 24. In a specific embodiment, the charging input at 26 is provided in the illustrative embodiment via rotation by a manual tool (not shown) as set forth in more detail in copending application Ser. No. 10/139,805 filed on May 3. 2002.

Figure 3:
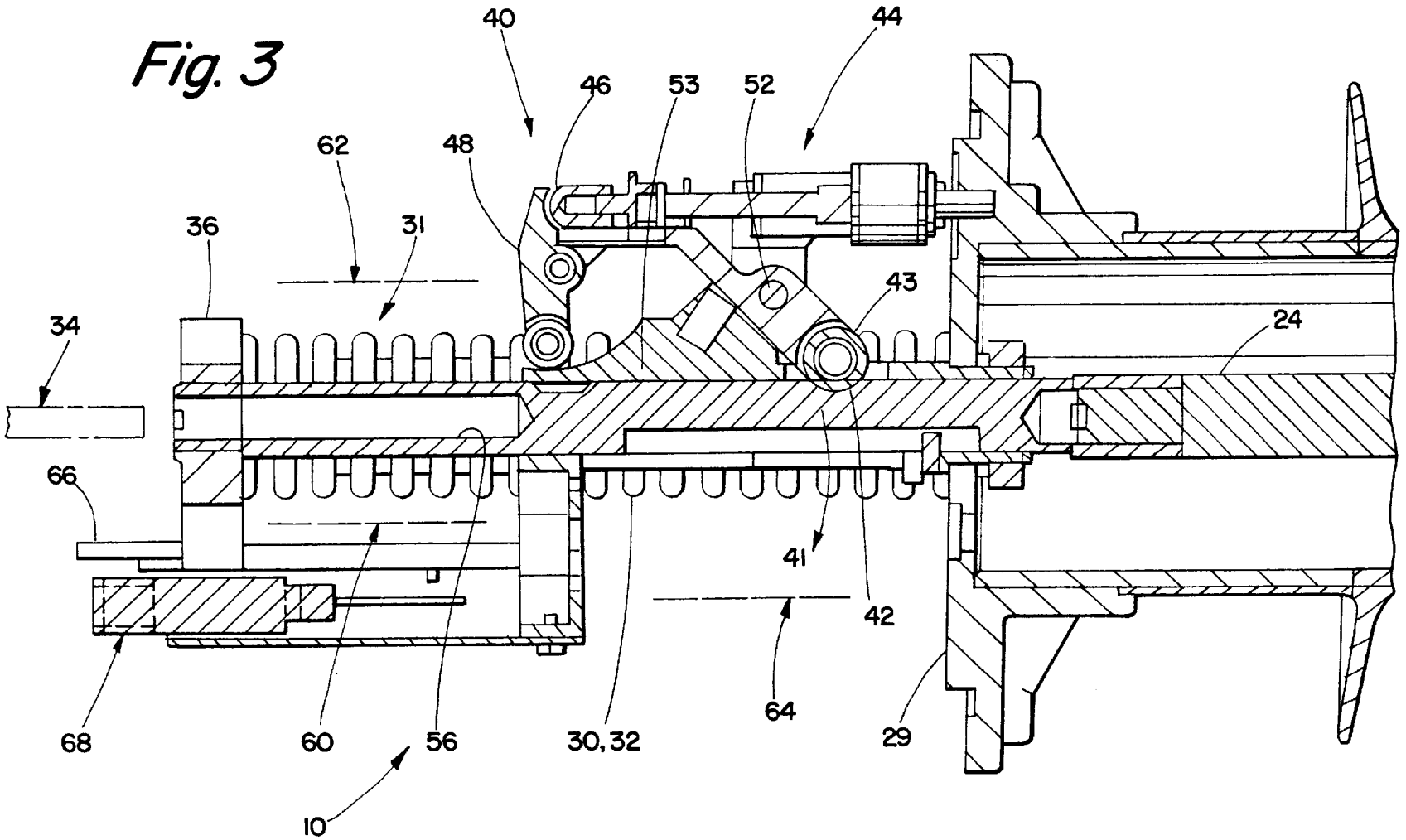
FIG. 3 is a top plan view of FIG. 2, partly in section and with parts cut away for clarity.
Figure 4:
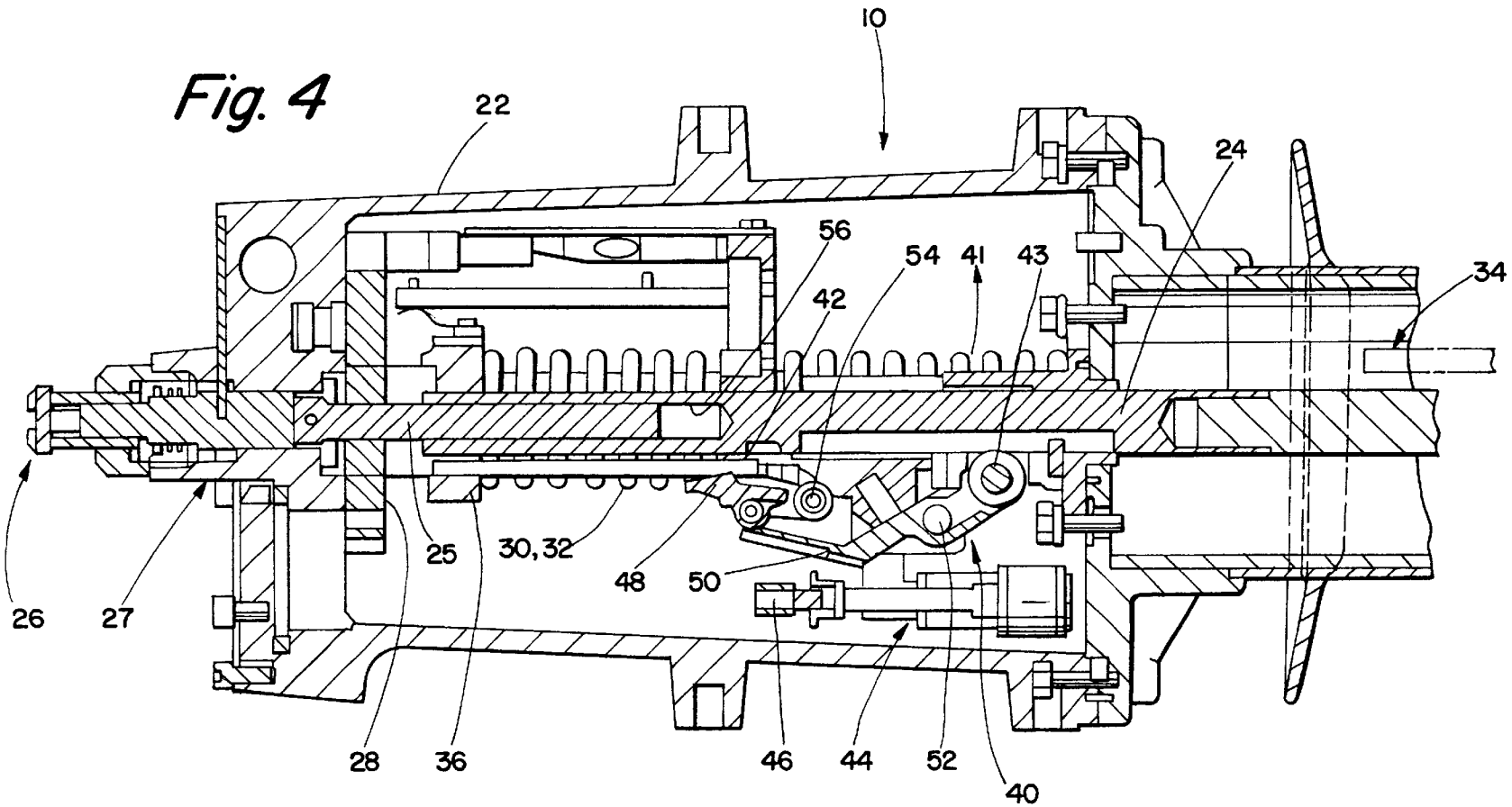
FIG. 4 is a bottom plan view of FIG. 2, partly in section and with parts cut away for clarity.

As seen in FIG. 2 and with additional reference now to FIGS. 3 and 4, the operating mechanism 10 includes a housing 22 that encloses an array of linear springs generally referred to at 31, e.g. in the specific illustrative embodiment, two springs 30, 32, that define a plane or array, e.g. as illustrated diagrammatically at 34. The springs 30, 32 act between one end 29 of the housing 22 and a shuttle 36 that may also be characterized as a carrier or carriage. The shuttle 36 is attached to the operating rod 24. The shuttle 36 is moved during charging at 26 via a charging arrangement 27 to charge the springs 30, 32 and move the operating rod 24 to the closed position of the interrupter 20 as shown in FIG. 3.

The charging arrangement 27 includes a charging screw 25 that is rotated by the charging input 26. The charging screw 25 drives a charging member 28, e.g. a threaded nut, in response to the charging input at 26, the charging member 28 contacting and moving the shuttle 36. The charging screw 25 is disposed within a receiving passage 56 of the operating rod 24. Accordingly, it can be seen that the charging arrangement 27 is contained within the operating mechanism 10 and provides an integral force-reducing arrangement for manual charging at the charging input 26, i.e. a relatively low force to rotate the charging input 26 is converted to translational charging movement of the shuttle 36 to charge the springs 30, 32.

Figure 9:
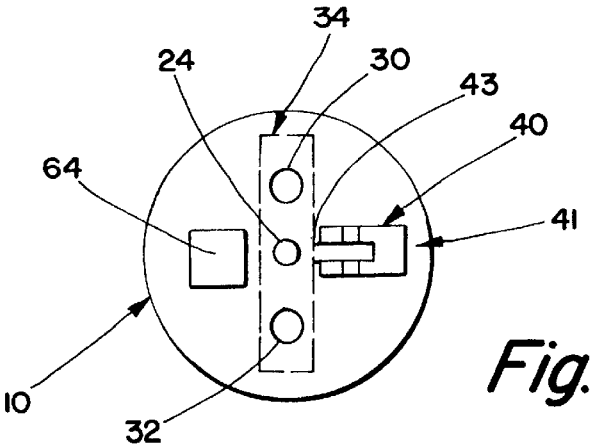
FIG. 9 is a diagrammatic view illustrating a cross section of the operating mechanism of FIG. 1–4.

When the shuttle 36 and the operating rod 24 reach the closed position, a latch arrangement 40 is set to latch the operating rod 24 in a detent 42 against the stored energy in the springs 30, 32. Thus, with the latch 40 set, the operating mechanism 10 is retained in the charged, closed position with stored energy in the springs 30, 32. The latch arrangement 40 is generally disposed intermediate the springs 30, 32 and acts in a direction 41 (FIGS. 3 and 4) that is generally perpendicular to the plane 34 of the spring array. This arrangement is shown diagrammatically in FIG. 9.

When the latch arrangement 40 is released, the shuttle 36 and the operating rod 24 move in response to the release of the energy stored in the springs 30, 32 to open the interrupter 20. In the illustrative embodiment, the latch arrangement 40 is released at 46 via the operation of a solenoid 44. The solenoid 44 at 46 acts against a secondary latch member 48 that holds a primary latch member 50 in the latched position. Upon movement of the secondary latch member 48, the primary latch member 50 is released and releases the operating rod 24 from the detent at 42 via a latch roller member 43. The operating rod 24 then moves to the open position, the open position of the operating rod 24 and the operating mechanism 10 is shown in FIGS. 2 and 4. The operating mechanism 10 is then again ready for charging via the charging input at 26.

Figure 5:
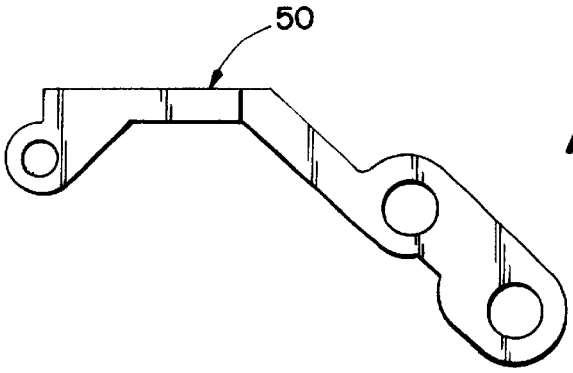
FIGS. 5–7 are respective front, top plan and left side elevational views of a primary latch member of the operating mechanism of FIGS. 1–4.
Figure 6:
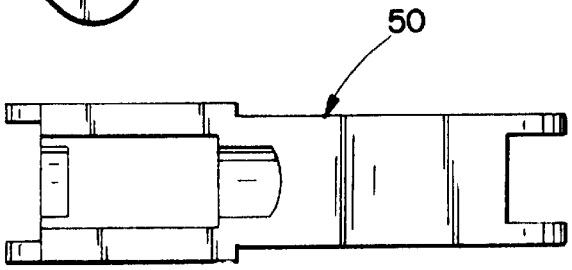
Figure 7:
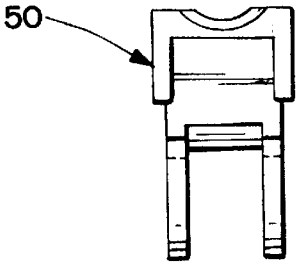
Figure 8:
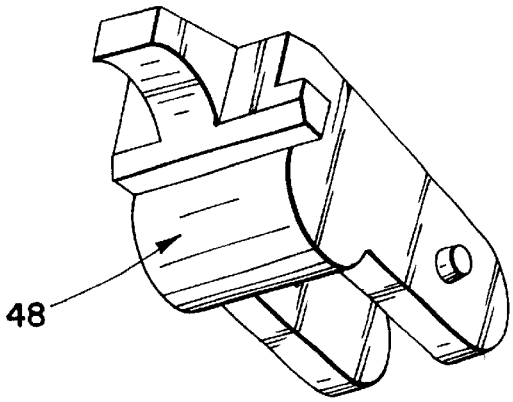
FIG. 8 is a perspective view of a secondary latch member of the operating mechanism of FIGS. 1–4.

The primary latch member 50 is pivotally mounted at 52 with respect to the housing 22 via a latch mounting member 53 that also provides a guide for the operating rod 24. The secondary latch member 48 is pivotally mounted with respect to the latch mounting member 53 at 54, the details of the primary latch 50 being shown in additionally referenced FIGS. 5–7 and the details of the secondary latch 48 being shown in additionally reference FIG. 8. The primary latch member 50 and the secondary latch member 48 are biased to return to their latched positions and are reset during the charging of the operating mechanism 10 as the roller member a 43 moves into the detent at 42 of the operating rod 24 in the charged position. The solenoid 44 is reset by a fork member 45 during the charging operation.

Thus, in accordance with important features of the present invention, it can be seen that the operating mechanism 10 with generally cylindrical shape provides an efficient layout and configuration while also including an integral force reducing charging arrangement 27 well suited for manual input. As can be seen in FIG. 3, the areas 60, 62 and 64 are available for additional components, e.g. the contact-state indicator 66 and the pressure gauge 68 in the area 60. Additionally, components may be provided in the areas 62 and 64 for additional control features of the operating mechanism 10, e.g. a power source to operate the solenoid 44 in response to an input either within or external to the pole unit 12.

Considering now additional important aspects of the present invention, the housing 22 of the operating mechanism 10 in a preferred embodiment provides a sealed environment containing a gas, e.g. an insulating gas such as $SF_6$. This is advantageous in implementations where the interrupter 20 contains a pressurized gas such as $SF_6$. In a preferred embodiment, the housing 22 is pressurized at the same pressure as the interrupter 20 such that no seals are required between the housing 22 and the circuit interrupter 20. The pressurized housing 22 of the operating mechanism 10 provides a non-corrosive environment for the housed components of the operating mechanism 10 as well as reducing the sealing demands of the interrupter 20. For example, it should be noted that the operating mechanism 10 and the overall pole unit 12 include only one sealing interface to the environment, e.g. at 70 (FIG. 4), this sealing interface being at the low speed, rotary input at 26 for recharging the operating mechanism 10. Thus, sealing requirements are minimized.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed is:

1. An operating mechanism for operating an electrical protective device comprising a housing, an output member extending from said housing, energy storage means capable of being charged and storing energy for moving the operating member between closed and open positions, and operating means movable between open and closed operating positions for charging said energy storage means and discharging said energy storage means to rapidly move said operating member from a closed position to an open position, said energy storage means comprising energy storage members that are arranged to define one or more planes, said operating means comprising latch means for selectively retaining and releasing said operating member, said latch means being disposed intermediate said energy storage members and comprising a latch member that is arranged to be operative in a direction generally perpendicular to said one or more planes, said operating means further comprising charging means responsive to a charging input for translating a low force input into a high force input, said charging means comprising first rotatable means responsive to said charging input and a drive screw driven by said first rotatable means.

2. The operating mechanism of claim 1 wherein said charging means further comprises second means driven by said drive screw.

3. The operating mechanism of claim 2 wherein said second means comprises a member including a threaded aperture arranged for cooperation with said drive screw.

4. The operating mechanism of claim 1 wherein said housing is generally cylindrical.

5. An operating mechanism for operating an electrical protective device comprising a housing, an output member extending from said housing, energy storage means capable of being charged and storing energy for moving the operating member between closed and open positions, and operating means movable between open and closed operating positions for charging said energy storage means and discharging said energy storage means to rapidly move said operating member from a closed position to an open position, said operating means further comprising charging means responsive to a charging input for translating a low force input into a high force input, said charging means comprising first rotatable means responsive to said charging input and a drive screw driven by said first rotatable means.

6. The operating mechanism of claim 5 wherein said charging means further comprises second means driven by said drive screw.

7. The operating mechanism of claim 6 wherein said second means comprises a member including a threaded aperture arranged for cooperation with said drive screw.

8. A single-pole circuit interrupter comprising a sealed housing containing a pressurized gas, relatively movable contacts and operating means for operating said relatively movable contacts, said operating means being responsive to a low-speed rotational charging input, said operating means comprising energy storage means capable of being charged and storing operating energy and charging means responsive to said low-speed rotational charging input for charging said energy storage means.

9. The arrangement of claim 8 wherein said charging means comprises first means for converting rotational movement to translational movement.

10. The arrangement of claim 9 wherein said first means converts a low force multi-turn rotational input into a high force translational output.

* * * * *